US005388535A

United States Patent [19]

Eshleman

[11] Patent Number: 5,388,535

[45] Date of Patent: Feb. 14, 1995

[54] WASTE MATERIAL FLOW CONTROL FEATURES IN A MATERIAL PROCESSING APPARATUS

[76] Inventor: Roger D. Eshleman, 506 Clayton Ave., Waynesboro, Pa. 17268

[21] Appl. No.: 151,326

[22] Filed: Nov. 12, 1993

[51] Int. Cl.[6] ..... F23G 5/00

[52] U.S. Cl. ..... 110/255; 110/229; 110/259; 110/289; 110/290

[58] Field of Search ..... 110/229, 289, 290, 255, 110/259, 257

[56] References Cited

U.S. PATENT DOCUMENTS

| | | | |
|---|---|---|---|
| 695,868 | 3/1902 | Nevegold | 110/289 |
| 997,529 | 7/1911 | Wilson | 110/229 |
| 4,534,301 | 8/1985 | Sakash et al. | 110/255 |
| 4,646,713 | 3/1987 | Honigsbaum | 110/229 X |
| 4,934,283 | 6/1990 | Kydd | 110/246 |

*Primary Examiner*—Edward G. Favors
*Attorney, Agent, or Firm*—Michael R. Swartz; John R. Flanagan

[57] ABSTRACT

A material processing apparatus includes a casing having a pyrolysis chamber for receiving and pyrolyzing feed materials therein into a gaseous material and solid ash residue, a mass of refractory material contained in the casing upon a bottom thereof, being spaced below a top and extending between opposite sides thereof, and including an inclined upper surface defining the bottom of the pyrolysis chamber and having a lower terminal edge being spaced from one of the opposite sides of the casing for defining a solid ash residue collection region therein, and a pusher mechanism disposed in the pyrolysis chamber for engaging and moving feed materials down the inclined upper surface of the refractory mass toward the lower terminal edge thereof. The apparatus also includes a shallow sloped terminal surface portion on the refractory mass inclined upper surface leading to the lower terminal edge thereof and a stop and release pivotal gate mechanism disposed over the collection region in the pyrolysis chamber and adjacent to the lower terminal edge and terminal surface portion on the refractory mass inclined upper surface which function together to control the flow of waste material from the terminal edge into the ash residue collection region so to regulate the residence time of the feed materials in the pyrolysis chamber before reaching the ash residue collection region therein to ensure substantially complete pyrolyzing of feed materials into gaseous and solid ash residue forms which are sterile, inert and non-hazardous to the environment.

21 Claims, 6 Drawing Sheets

WASTE MATERIAL FLOW CONTROL FEATURES IN A MATERIAL PROCESSING APPARATUS

CROSS REFERENCE TO RELATED APPLICATIONS

Reference is hereby made to the following copending U.S. applications dealing with subject matter related to the present invention:

1. "Apparatus And Method For Controlled Processing Of Materials" by Roger D. Eshleman and Paul S. Stevers, assigned U.S. Ser. No. 07/987,928 and filed Dec. 9, 1992.
2. "Apparatus And Method For Transferring Batched Materials" by Roger D. Eshleman, assigned U.S. Ser. No. 08/123,455 and filed Mar. 5, 1993.
3. "Sloped-Bottom Pyrolysis Chamber And Solid Residue Collection System In A Material Processing Apparatus" by Roger D. Eshleman, assigned U.S. Ser. No. 08/123,435 and filed Sep. 17, 1993.
4. "Material Transport Pusher Mechanism In A Material Processing Apparatus" by Roger D. Eshleman, assigned U.S. Ser. No. 08/123,747 and filed Sep. 17, 1993.
5. "Method And Apparatus For Infeeding Batched Materials" by Roger D. Eshleman, assigned U.S. Ser. No. 08/157359 and filed Nov. 23, 1993.

BACKGROUND OF THE INVENTION

1. Field of the Invention

The present invention generally relates to material processing and, more particularly, is concerned with features for controlling the flow of waste materials, such as medical and other waste matter, during pyrolyzing of such materials in a pyrolysis chamber of a material processing apparatus to thereby control residence time of such materials therein and ensure completion of the pyrolyzing of such material in the pyrolysis chamber.

2. Description of the Prior Art

The problem of disposal of waste matter involves a material processing challenge that is becoming increasingly acute. The primary material processing methods of waste disposal have been burning in incinerators and burial in landfills. These two material processing methods have severe disadvantages. Burning of waste liberates particulate matter and fumes which contribute to pollution of the air. Burial of wastes contributes to the contamination of ground water. A third material processing method is recycling of waste. Although increasing amounts of waste are being recycled, which alleviates the problems of the two primary material processing methods, presently available recycling methods do not provide a complete solution to the waste disposal problem.

The problem of disposal of biomedical waste materials is even more acute. The term "biomedical waste materials" is used herein in a generic sense to encompass all waste generated by medical hospitals, laboratories and clinics which may contain hazardous, toxic or infectious matter whose disposal is governed by more stringent regulations than those covering other waste. It was reported in *The Wall Street Journal* in 1989 that about 13,000 tons a day of biomedical waste, as much as 20% of it infectious, is generated by around 6,800 U.S. hospitals.

Hospitals and other generators of biomedical waste materials have employed three main material processing methods of waste handling and disposal: (1) on-site incineration with only the residue transferred to landfills; (2) on-site steam autoclaving and followed by later transfer of the waste to landfills; and (3) transfer of the waste by licensed hazardous waste haulers to off-site incinerators and landfills. Of these three main material processing methods, theoretically at least, on-site disposal is the preferred one.

However, many hospital incinerators, being predominantly located in urban areas, emit pollutants at a relatively high rate which adversely affect large populations of people. In the emissions of hospital incinerators, the Environmental Protection Agency (EPA) has identified harmful substances, including metals such as arsenic, cadmium and lead; dioxins and furans; organic compounds like ethylene, acid gases and carbon monoxide; and soot, viruses, and pathogens. Emissions of these incinerators may pose a public health threat as large as that from landfills.

Nonetheless, on-site disposal of biomedical waste materials still remains the most promising solution. One recent on-site waste disposal unit which addresses this problem is disclosed in U.S. Pat. No. 4,934,283 to Kydd. This unit employs a lower pyrolyzing chamber and an upper oxidizing chamber separated by a movable plate. The waste material is deposited in the lower chamber where it is pyrolyzed in the absence of air and gives off a combustible vapor that, in turn, is oxidized in the upper chamber. While this unit represents a step in the right direction, it does not appear to approach an optimum solution to the problem of biomedical waste material disposal.

One problem with the approach of the aforementioned patent is that it proposes the use of an on-site waste disposal unit which is dedicated to the disposal of biomedical waste material. This approach requires that more than one incineration system be installed and maintained at hospitals, namely, one for biomedical waste and another for all other hospital waste. Resistance has been encountered to the adoption of this approach by hospitals due to added cost of installation, operation and maintenance. An urgent need has developed for an all-purpose material processing apparatus which can handle disposal of all types of hospital waste materials, both biomedical waste and general waste, such as metal needles and glass and plastic bottles.

SUMMARY OF THE INVENTION

The present invention provides waste materials flow control features for a material processing apparatus designed to satisfy the aforementioned needs. The flow control features of the present invention permits greater control over the residence time of biomedical and general hospital waste material, such as metal needles and glass and plastic bottles, in the pyrolysis chamber of the apparatus so as to ensure a substantially complete reduction of such waste material to gaseous and solid ash residue forms which are substantially sterile, inert and non-hazardous to the environment.

Accordingly, the present invention is directed to features for controlling the flow of waste material in a pyrolysis chamber of a material processing apparatus. The material processing apparatus in which such features are incorporated includes: (a) a casing having a top and bottom and a plurality of sides defining the pyrolysis chamber for receiving feed materials therein and pyrolyzing the feed materials into a gaseous material and a solid ash residue; and (b) a mass of refractory material contained in the casing upon the bottom thereof and spaced below the top thereof and extending between the sides thereof, the refractory mass including an inclined upper surface defining a bottom of the pyrolysis chamber and having a lower terminal edge being spaced from a first one of the sides of the casing so as to form an elongated cavity at the forward end of the refractory mass defining a solid ash residue collection region therein.

In accordance with one feature of the present invention for controlling the flow of waste material in the pyrolysis chamber, the material processing apparatus incorporates a lower section of the inclined upper surface of the refractory mass having a shallower slope or inclination than an upper section thereof. The upper section is substantially longer than the lower section.

In accordance with another feature of the present invention for controlling the flow of waste material in the pyrolysis chamber, the material processing apparatus further incorporates a feed material stop and release control mechanism mounted to the casing and the pyrolysis chamber. The control mechanism includes a gate disposed above the solid ash residue collection region adjacent to the lower section of the inclined upper surface of the refractory mass and mounted between the opposite sides of the pyrolysis chamber to undergo pivotal movement between closed and opened positions. The control mechanism also includes an actuator mounted to the exterior of the casing of the apparatus and coupled to the pivotal gate. The actuator is operable to pivotally move the gate between the closed and opened positions relative to the top opening to the solid ash residue collection region in the pyrolysis chamber.

The lower surface section on the inclined upper surface of the refractory mass and the material stop and release control mechanism function together to regulate the residence time of the feed materials within the pyrolysis chamber by (1) the shallower-sloped lower surface section serving to slow and retard the speed of descent of the material sliding down the inclined upper surface as it nears the lower terminal edge thereof and before reaching the ash residue collection region and (2) the pivotal gate of the control mechanism serving to prevent the material from passing down into the ash residue collection region while the gate is maintained in a closed position. The cooperation between these features ensure substantially complete pyrolyzing of the feed materials in the pyrolysis chamber into gaseous and solid ash residue forms which are sterile, inert and non-hazardous to the environment.

These and other features and advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DETAILED DESCRIPTION OF THE INVENTION

Figure 1:
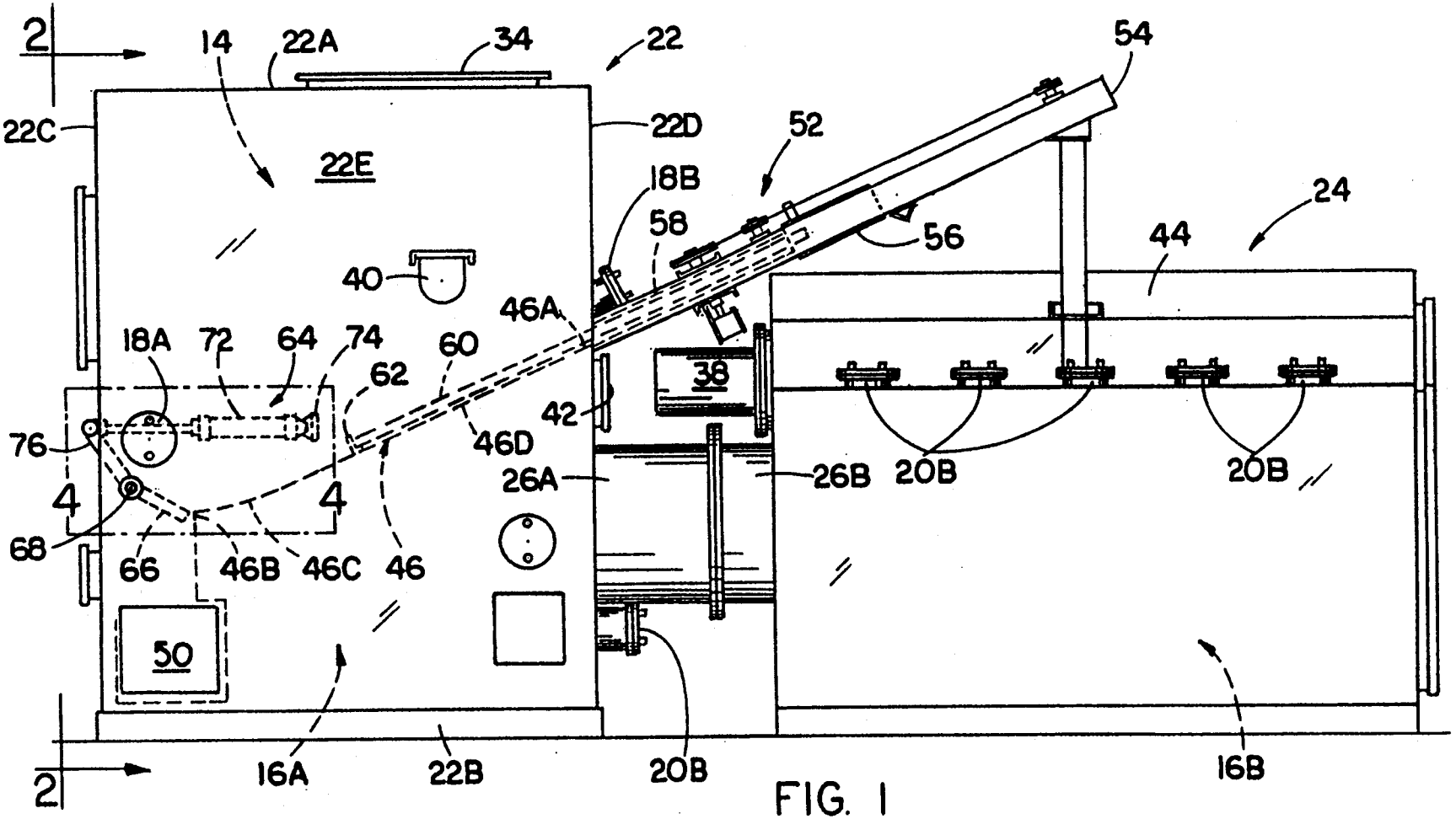
FIG. 1 is a side elevational view of an apparatus for processing of a wide variety of diverse materials, particularly all types of biomedical and other waste materials generated by health care institutions, such as hospitals, showing the features of the present invention incorporated by the material processing apparatus.
Figure 2:
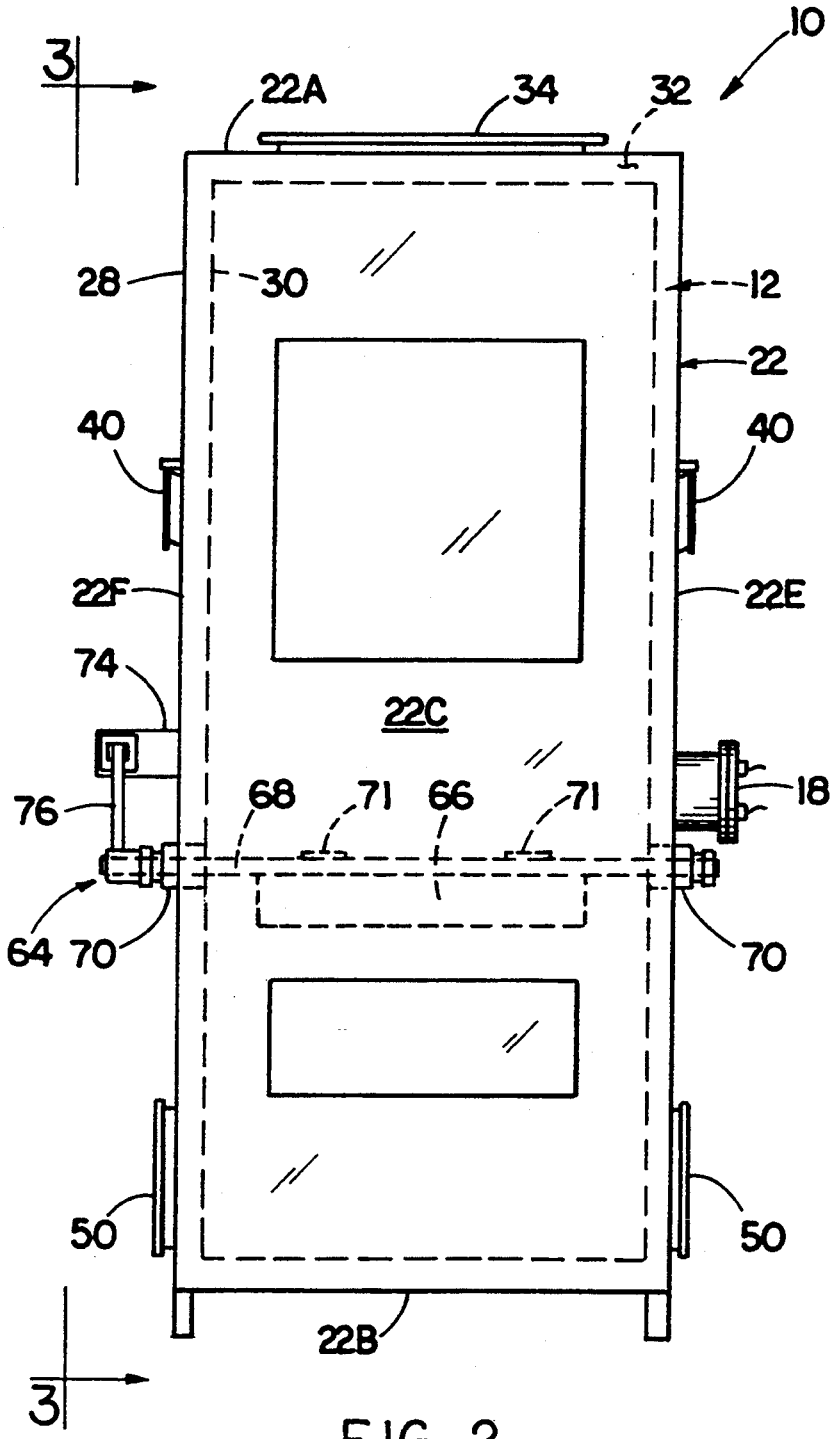
FIG. 2 is an enlarged front end elevational view of a first housing unit of the apparatus as seen along line 2—2 of FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Material Processing Apparatus—In General

Referring now to the drawings, and particularly to FIG. 1, there is illustrated an apparatus, generally designated 10, for controlled processing of materials, and in particular for controlled disposal of all types of biomedical and other waste materials generated by health care institutions, such as hospitals, which apparatus 10 incorporates several features in accordance with the present invention. The material processing apparatus 10 basically includes a coolant jacketed vessel 12 defining a first pyrolysis chamber 14 and a second oxidation chamber 16. The apparatus 10 also includes a plurality of first heater units 18 mounted in the first chamber 14 of the vessel 12 and being operable to electrically generate heat for pyrolyzing materials in the first chamber 14, and a plurality of second heater units 20 mounted in the second chamber 16 of the vessel 12 and being operable to electrically generate heat for oxidizing materials in the second chamber 16. The first and second heat units 18, 20 have substantially the same construction and function as those disclosed in the first patent application cross-referenced above, which disclosure is incorporated herein by reference.

The apparatus 10, being provided in the form of two separate first and second units 22, 24 which are disposed in end-to-end relation to one another, has a casing 26 with outer and inner spaced walls 28, 30 forming the coolant jacketed airtight pressure vessel 12 inside of the inner wall 30 and providing a channel 32 between the outer and inner walls 28, 30. The channel 32 surrounds the vessel 12 and contains the flow of coolant fluid, such as water. The casing 26 of the apparatus 10 includes a pair of tubular extensions 26A, 26B which are fastened together to interconnect an outlet of the first unit 22 with an inlet of the second unit 24 in flow communication with one another.

Figure 3:
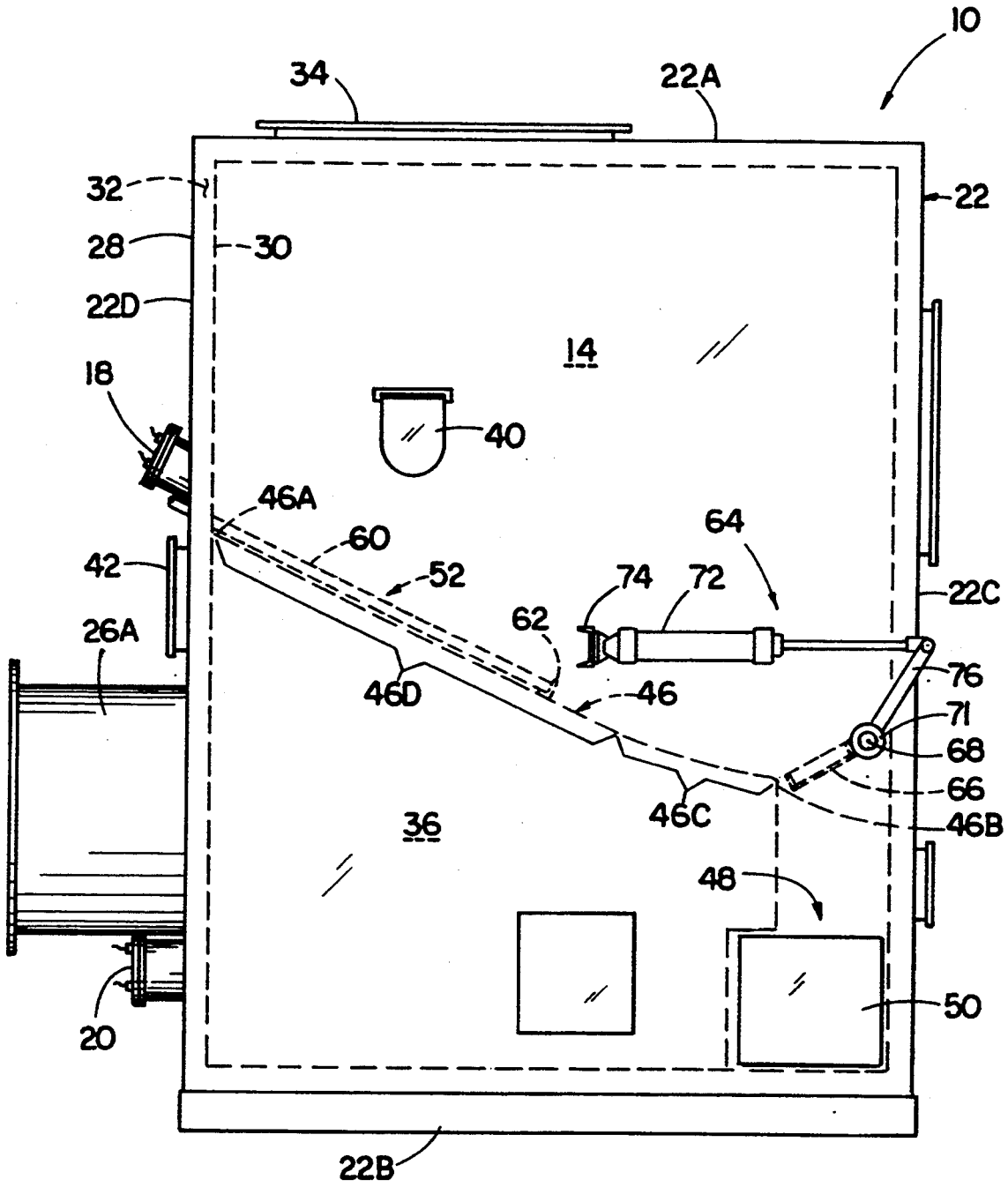
FIG. 3 is a side elevational view of the first housing unit of the apparatus as seen along line 3—3 of FIG. 2.
Figure 4:
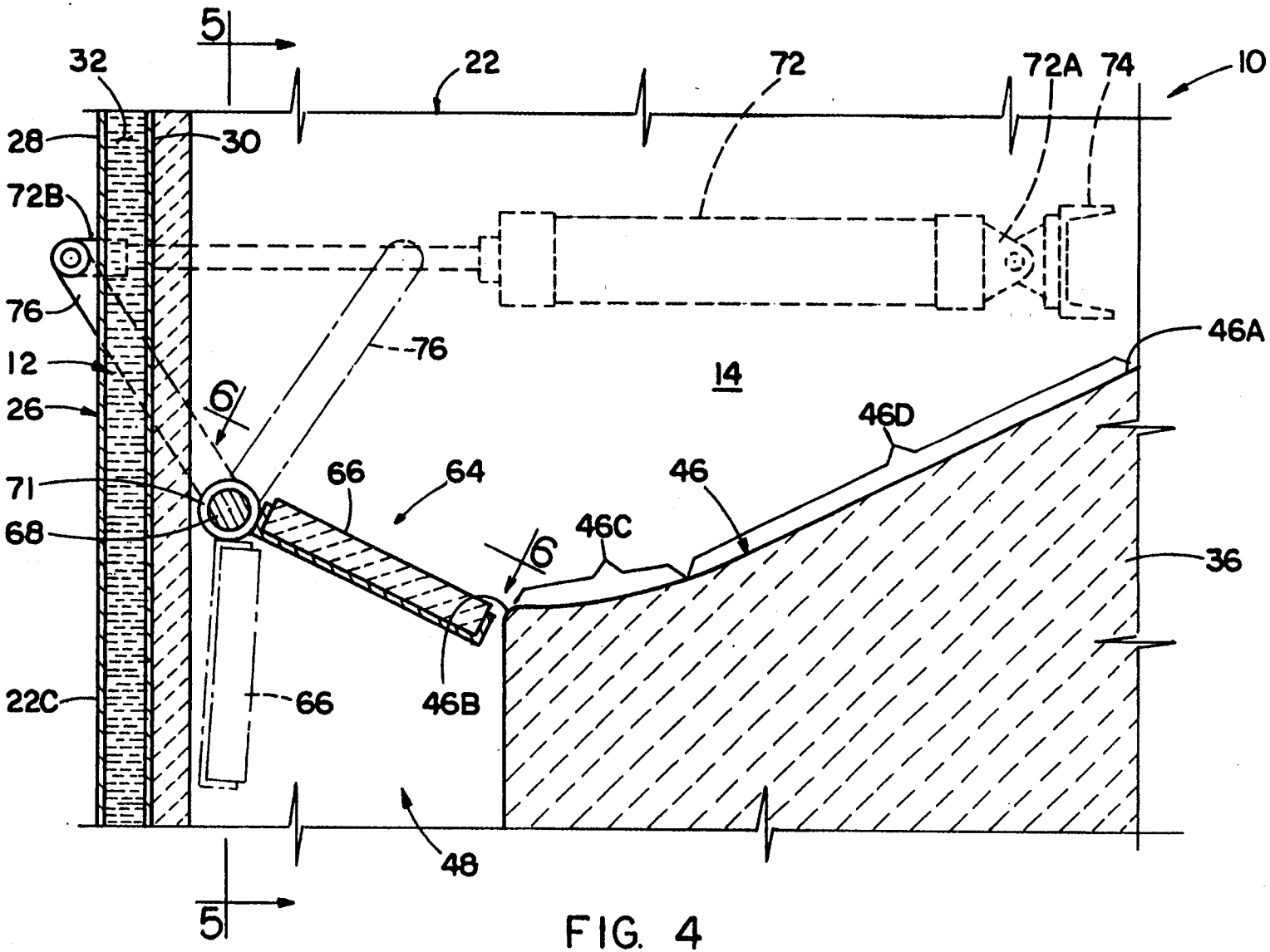
FIG. 4 is an enlarged fragmentary vertical sectional view of the portion of the first housing unit of the apparatus enclosed by the rectangle 4—4 of FIG. 1.
Figure 5:
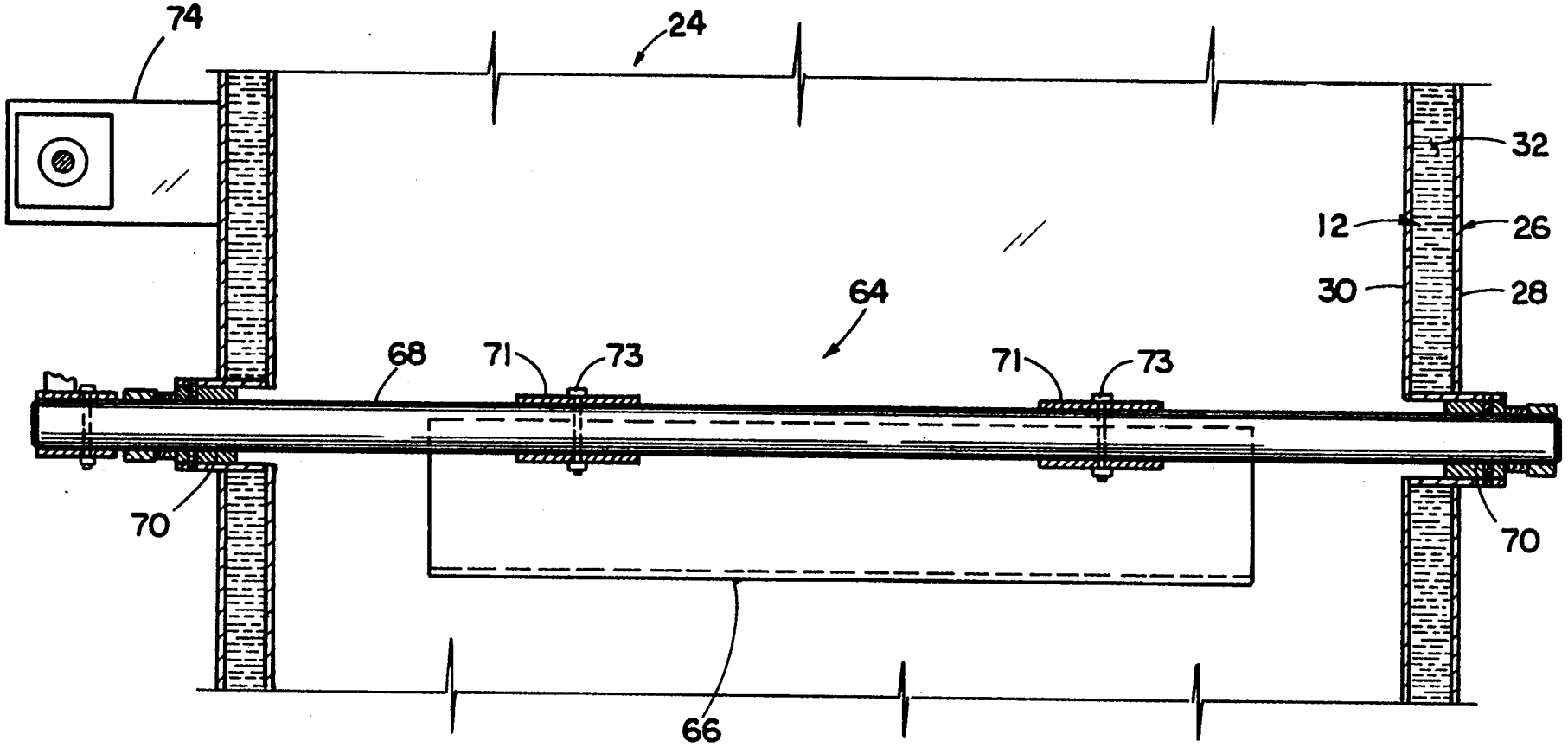
FIG. 5 is a transverse vertical sectional view taken along line 5—5 of FIG. 4.
Figure 6:
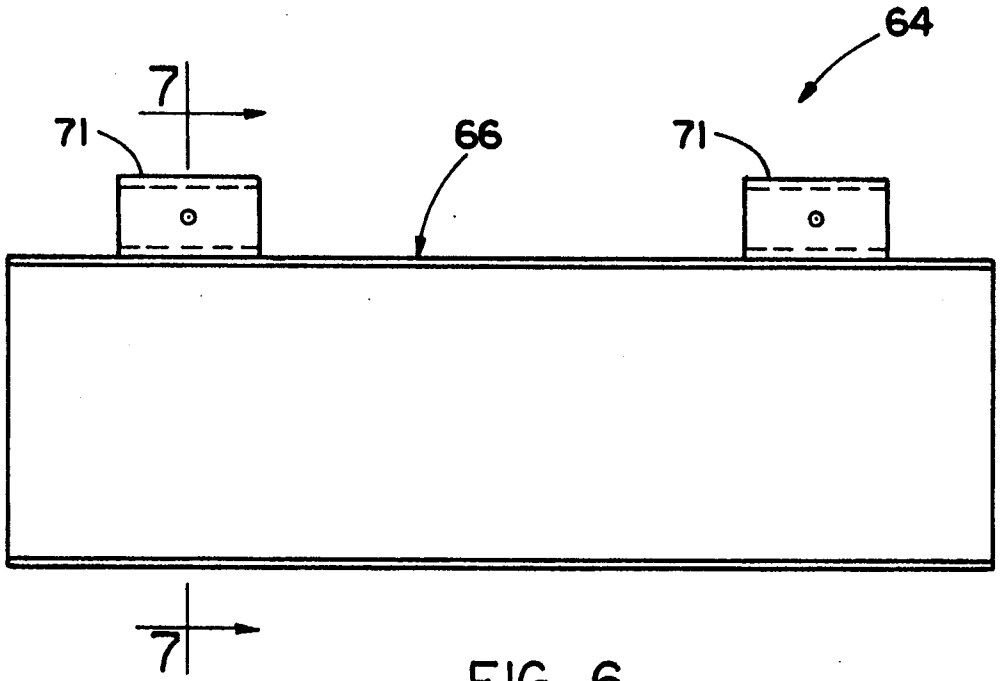
FIG. 6 is a rear elevational view of an ash stop and release gate of the ash residue flow control mechanism of the apparatus as seen along line 6—6 of FIG. 4.
Figure 7:
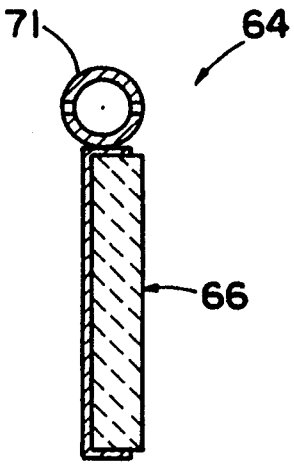
FIG. 7 is a vertical cross-sectional view of the gate taken along line 7—7 of FIG. 6.

Referring to FIGS. 1, 3 and 4, the vessel 12 defines the first pyrolysis chamber 14 having an inlet 34 and the second oxidation chamber 16 connected in communication with the first pyrolysis chamber 14 and having the discharge outlet (not shown). The first chamber 14 in which the materials will be pyrolyzed receives the materials through the inlet 34 via operation of a suitable loading mechanism (not shown), such as the ones disclosed in the second and fifth patent applications cross-referenced above, the disclosures of which is incorporated herein by reference. The first chamber 14 of the vessel 12 for pyrolyzing materials is disposed in the first unit 22. The material, through pyrolysis, or burning in a starved oxygen atmosphere, is converted to a gas that exits the first chamber 14 by passing into the second chamber 16.

The second chamber 16 receives the pyrolyzed gaseous materials from the first chamber 14 and, after oxidizing the pyrolyzed materials therein, discharges the oxidized materials therefrom through the discharge outlet. The second chamber 16 has primary and secondary sections 16A, 16B for oxidizing materials in two successive stages. The primary section 16A is disposed in the first unit 22 of the vessel 12 between the first chamber 14 and the tubular extensions 26A, 26B. The secondary section 16B is disposed in the second unit 24 of the vessel 12. The primary section 16A is defined by a system of interconnected passages or tunnels (not shown) defined in a mass 36 of refractory material contained in the bottom of the first unit 22. The secondary section 16B of the second chamber 16 is located in the second unit 24. The oxidized gas material from the primary section 16A of the second chamber 16 flows through the tunnel system in the refractory mass 36 and then through the tubular extensions 26A, 26B, and into the secondary section 16B in the second unit 24.

The apparatus 10 further includes an air flow generating means, preferably an induction fan 38 connected in flow communication with the first and second chambers 14, 16, and with first and second airflow inlet valves 40, 42 connected to the jacketed vessel 12. The induction fan 38 and first and second inlet valves 40, 42 are controlled in a manner disclosed in the first patent application cross-referenced above so as to function to produce separate primary and secondary variable flows of air respectively into and through the first and second chambers 14, 16. Additionally, the apparatus 10 includes a heat exchanger 44 connected in flow communication between the second chamber 16 and the discharge outlet. The heat exchanger 44 functions to remove heat from and thereby cool the coolant flowing through the channel 32 defined by jacketed vessel 12. The material processing apparatus 10 operates through one cycle to process, that is to pyrolyze and oxidize, a batch of the diverse waste material. The heat exchanger 44 is also located in the second unit 24 above the secondary section 16B of the second chamber 16. The upper heat exchanger 44 has the induction fan 38 connected at one end which operates to draw the gases from the first chamber 14 into the primary section 16A of the second chamber 16 via the tunnel system and the secondary section 16B of the second chamber 16, then up and forwardly through the center of the heat exchanger 44 to the center of the induction fan 38 which then forces the exhaust gas outwardly and rearwardly around and along the heat exchanger 44 for exiting through the discharge outlet into a wet scrubber (not shown). The exhaust gas is virtually free of any pollution and the original material has been almost completely oxidized so that only a very small amount of fine minute dust or powder particles are collected in a particle separator (not shown).

Also, as disclosed in the first cross-referenced application, the apparatus 10 includes temperature sensors (not shown) which are mounted on the vessel 12 for sensing the temperatures in the first and second chambers 14, 16 and in the coolant circulating about the channel 32 defined by the jacketed vessel 12 about the first and second chambers 14, 16. Further, as disclosed in the first cross-referenced application, the apparatus 10 includes a gas sensor (not shown) which is mounted on the discharge outlet of the vessel 12 for sensing the concentration of a predetermined gas, for example oxygen, in the discharge gases. Still further, as disclosed in the first cross-referenced application, the apparatus 10 incorporates a computer-based control system for controlling and directing the overall operation of the apparatus. The control system is responsive to the temperatures sensed in the first and second chambers 14, 16 by temperature sensors (not shown) and in the coolant circulating through the channel 32 of the jacketed vessel 12 by another temperature sensor (not shown). The control system also is responsive to the proportion of the predetermined gas, such as oxygen, sensed in the discharge gases by the gas sensor (not shown). The control system, in response to these various temperatures sensed and to the proportion of oxygen sensed, operates to adjust the ratio of or proportion the amount of primary air flow to the amount of secondary air flow through the first and second inlet valves 40, 42 into the first and second chambers 14, 16. Also, the control system, in response to these various temperatures sensed and to the proportion of oxygen sensed, operates to control the operation of the induction fan 38 so as to adjust the amounts (but not proportion) of primary and secondary air flows into the first and second chambers 14, 16.

Sloped-Bottom Pyrolysis Chamber And Solid Residue Collection Region

Referring to FIGS. 1–4, the first unit 22 of the casing 26 has a top 22A and bottom 22B, a pair of opposite front and rear ends 22C, 22D and a pair of opposite sides 22E, 22F. The refractory mass 36 is contained in the first unit 22 upon the bottom 22B thereof and extending between the opposite ends 22C, 22D and opposite sides 22E, 22F thereof. The refractory mass 36 has an upper surface 46 spaced below the top 22A of the first unit 22. The upper surface 46 defines a bottom of the first pyrolysis chamber 14 and has a pair of opposite upper and lower ends 46A, 46B. The upper surface 46 has an inclined orientation extending upwardly and rearwardly from the front end 22C to the rear end 22D of the first unit 22. The refractory mass 36 also has an elongated cavity 48 defined therein along the front end 22C of the first unit 22 of the casing 26 and adjacent to the lower front end 46B of the upper inclined surface 46 of the refractory mass 36. The cavity 48 has a generally rectangular cross-section and extends between bottom 22B of the casing 26 and the upper surface 46 on the refractory mass 36. The elongated cavity 48 constitutes a solid residue collection region which includes an elongated collection pan (not shown) being removable through either one of a pair of opposite openings defined in the opposite sides 22E, 22F of the first unit 22 of the casing 26 and covered by removable closures 50.

Material Transport Pusher Mechanism

Referring to FIGS. 1 and 3, the material processing apparatus 10 also includes a pusher mechanism 52 for moving material across the upper inclined surface 48 of the refractory mass 36 which is the bottom of the first chamber 14. The pusher mechanism 52 functions to prevent buildup of non-consumable materials, such as glass and certain metals, upon the upper inclined surface 46 from where they would be difficult to remove once they have cooled. The pusher mechanism 52 is mounted to and extends through the rear end 22D of the first unit 22 of the casing 26 and is operable to engage and push the materials across the upper inclined surface 46 of the refractory mass 36 along a path extending parallel to the direction from the upper end 46A toward the lower end 46B of the upper surface 46 and thereby into the collection pan (not shown) seated within the cavity 48 adjacent the front end 22C of the casing 26.

Referring particularly to FIG. 1, the pusher mechanism 52 includes an elongated track 54, a movable carriage 56 and an elongated actuator 58 all being disposed at the exterior of the first unit 22 of the casing 26. The track 54 of the pusher mechanism 52 is mounted to the rear end 22D of the first unit 22 and extends outwardly and rearwardly therefrom in an inclined orientation. The carriage 56 of the pusher mechanism 52 is mounted to the track 54 so as to undergo sliding reciprocal movement therealong between first and second displaced positions toward and away from the first unit 22 of the casing 26. The actuator 58 of the pusher mechanism 52, preferably in the form of a hydraulic cylinder, is mounted at its cylinder end to the rear end 22D of the casing 26 and coupled at an opposite piston rod end to the carriage 56. Selective operation of the actuator 58 through retraction and extension of its piston rod will cause the sliding reciprocal movement of the carriage 56 between the first and second displaced positions.

The pusher mechanism 52 also includes an elongated pusher arm 60 having a scraper blade 62 mounted transversely across the forward terminal end of the pusher arm 60. The pusher arm 60 at its rearward end is connected to the carriage 56 and is slidably movable into the first pyrolysis chamber 14 through the rear end 22D of the first unit 22. The transverse scraper blade 62 engages the upper inclined surface 46 of the refractory mass 36 and any solid material received thereon.

As the actuator 58 is retracted, the carriage 56 and pusher arm 60 are respectively moved toward the first unit 22 and the front end 22C thereof so as to cause the blade 62 to move toward the first displaced or extended position located near the cavity 48 and thereby transport or push the solid material down the inclined upper surface 46 and over its lower terminal end 46B and into the collection region defined by the cavity 48. To reset the pusher mechanism 52, the actuator 58 is extended to retract the carriage 56 away from the first unit 22 and the pusher arm 60 from the pyrolysis chamber 14 and thereby move the blade 62 toward the second displaced or retracted position located adjacent to the rear end 22D of the first unit 22 and remote from the cavity 48.

Material Stop and Release Control Mechanism

Referring to FIGS. 1–6, the present invention is directed to features for controlling the flow of waste material in the pyrolysis chamber 14 of the apparatus 10. These features cooperate and function together to regulate (by lengthening or extending) the residence time of the feed materials within the pyrolysis chamber so as to ensure substantially complete pyrolyzing of the feed materials in the pyrolysis chamber 14 into gaseous and solid ash residue forms which are sterile, inert and non-hazardous to the environment.

One of these features of the present invention for controlling the flow of the waste material is a lower surface section 46C of the inclined upper surface 46 of the refractory mass 36 being provided with a slope or inclination that is shallower than that of an upper surface section 46D thereof. Preferably, the lower surface section 46C approaches a nearly horizontal plane. The upper surface section 46D of the inclined upper surface 46 constitutes most of the length thereof, being substantially longer than the lower section 46C. The shallower-sloped lower surface section 46C on the inclined upper surface 46 of the refractory mass 36 contributes to regulation of the residence time of the feed materials within the pyrolysis chamber 14 by serving to slow and retard the speed of descent of the material sliding down the inclined upper surface 46 as they near the lower terminal edge 46B thereof and before reaching the ash residue collection region defined by the cavity 48. The scraper blade 62 of the pusher mechanism 52 when at the first displaced position is located proximately the lower end of the upper surface section 46D and near the upper end of the lower surface section 46C of the inclined upper surface 46. Thus, during its movement down the inclined upper surface 46, the scraper blade 62 never actually reaches the shallower-sloped lower surface section 46C.

Another of these features of the present invention for controlling the flow of waste material is a feed material stop and release control mechanism 64 mounted to casing 22 and extending within the pyrolysis chamber 14. The control mechanism 64 includes a gate 66 of generally elongated rectangular shape being disposed above the solid ash residue collection region 44 adjacent to the lower surface section 46C of the inclined upper surface 46 of the refractory mass 36 and mounted between the opposite sides 22E, 22F of the casing 22 to undergo pivotal movement between closed and opened positions. The control mechanism 64 also includes an elongated shaft 68 extending across the pyrolysis chamber 14 above the cavity 48 and extending through and rotatably mounted at its opposite end portions by bearings 70 to the opposite sides of the casing 22. The gate 66 is secured to the shaft 68 by a pair of annular bushings 71 inserted over the shaft 68 and a pair of fasteners 73 inserted through the respective bushings 71 and the shaft 68.

The control mechanism 64 further includes an actuator 72 disposed along the exterior of the casing 22 and coupled to the pivotal gate 66. The actuator 72 is mounted at a cylinder end 72A by a bracket 74 to the one side 22F of the casing 22 and coupled at a piston rod end 72B to a crank arm 76 attached to an end of the gate shaft 68 at the exterior of the one side 22F of the casing 22. The actuator 72 is extendable and retractable to rotate the shaft 68 via the crank arm 76 and thereby pivotally move the gate 66 between the closed and opened positions relative to the open top of the cavity 48 defining the solid ash residue collection region in the pyrolysis chamber 14 at the end of the refractory mass 36.

The material stop and release control mechanism 64 contributes to the regulation of the residence time of the feed materials within the pyrolysis chamber 14 by preventing the material from passing off the lower terminal end 46B of the inclined upper surface 46 and descending into the cavity 48 while the gate 66 is being maintained in the closed position (as shown in solid line form in FIG. 4) and then by permitting passage of the material into the cavity 48 once the gate 66 has been pivoted to the opened position (as shown in dashed line form in FIG. 4).

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A material processing apparatus, comprising:

(a) a casing having a top and bottom and a plurality of sides defining a pyrolysis chamber for receiving feed materials therein and pyrolyzing the feed materials into a gaseous material and a solid ash residue;

(b) a mass of refractory material contained in the casing upon the bottom thereof and spaced below the top thereof and extending between the sides thereof, the refractory mass including an upper surface defining a bottom of the pyrolysis chamber and having a terminal edge being spaced from a first one of the sides of the casing for defining a solid ash residue collection region therein; and (c) means disposed in the pyrolysis chamber adjacent to said terminal edge of said upper surface of said refractory mass for controlling the flow of waste material from the terminal edge into the ash residue collection region so as to regulate the residence time of the feed materials in the pyrolysis chamber before reaching the ash residue collection region therein to ensure substantially complete pyrolyzing of the feed materials into gaseous and solid ash residue forms which are substantially sterile, inert and non-hazardous to the environment, said material flow controlling means including a feed material stop and release control mechanism mounted to said casing and extending within said pyrolysis chamber above said solid ash residue collection region therein and being operable to selectively prevent and permit passage of the feed material, after pyrolysis, into said solid ash residue collection region.

2. The apparatus as recited in claim 1, wherein said upper surface of said refractory mass is inclined and said waste material flow controlling means includes a lower surface section being provided on said inclined upper surface with a slope that is shallower than that of an upper surface section of said inclined upper surface such that said shallower-sloped lower surface section contributes to regulation of the residence time of the feed materials within said pyrolysis chamber by slowing the speed of descent of the feed materials down said inclined upper surface as the materials near said lower terminal edge thereof before reaching said solid ash residue collection region.

3. The apparatus as recited in claim 2, wherein said lower surface section of said inclined upper surface is disposed in a nearly horizontal plane.

4. The apparatus as recited in claim 2, wherein said upper surface section of said inclined upper surface is substantially longer than said lower surface section thereof.

5. The apparatus as recited in claim 1, further comprising:

means disposed in said pyrolysis chamber for engaging and moving feed materials, received in said pyrolysis chamber and being pyrolyzed therein, across said upper surface of said refractory mass toward said terminal edge thereof.

6. The apparatus as recited in claim 5, wherein said engaging and moving means is a pusher mechanism mounted to and extending through a second one of said sides of said casing being opposite from said first one of said sides thereof, said pusher mechanism being operable between first and second displaced positions to engage and transport materials received on said inclined upper surface of said refractory mass and being pyrolyzed in said chamber across said inclined upper surface of said refractory mass toward said terminal end thereof.

7. The apparatus as recited in claim 6, wherein said pusher mechanism includes an elongated pusher arm extending through said second one of said casing sides and into said pyrolysis chamber and having a blade attached to a terminal end of said arm being engageable with the materials received on said upper surface of said refractory mass, said elongated pusher arm being reciprocally movable relative to said refractory mass between said first and second displaced positions to move said blade thereof between extended and retracted positions in which said blade is respectively located adjacent to and remote from said terminal end of said upper surface of said refractory mass and said solid ash residue collection region adjacent thereto.

8. The apparatus as recited in claim 1, wherein said stop and release control mechanism includes:

an elongated gate; and means for mounting said gate above said solid ash residue collection region adjacent to said terminal end of said upper surface of said refractory mass and to undergo pivotal movement between closed and opened positions and thereby regulate the residence time of the feed materials within the pyrolysis chamber by selectively preventing and permitting the material to pass over said terminal end of said upper surface and descend into said solid ash residue collection region.

9. The apparatus as recited in claim 8, wherein said gate mounting means is an elongated shaft extending across said pyrolysis chamber above said solid ash residue collection region and extending through and rotatably mounted at its opposite end portions to a pair of said opposite sides of said casing.

10. The apparatus as recited in claim 8, wherein said stop and release mechanism also includes an actuator mounted along an exterior of said casing and coupled to said shaft, said actuator being extendable and retractable to rotate said shaft and thereby pivotally move said gate between said closed and opened positions relative to said solid ash residue collection region.

11. The apparatus as recited in claim 1, wherein said solid ash residue collection region is an elongated cavity defined in said casing along one of said opposite sides thereof and adjacent to said terminal end of said upper surface of said refractory mass.

12. The apparatus as recited in claim 11, wherein said stop and release control mechanism includes:

an elongated gate; and means for mounting said gate across an open top of said elongated cavity defining said solid ash residue collection region adjacent to said terminal end of said upper surface of said refractory mass and to undergo pivotal movement between closed and opened positions and thereby regulate the residence time of the feed materials within the pyrolysis chamber by selectively preventing and permitting the material to pass over said terminal end of said upper surface and descend into said solid ash residue collection region.

13. The apparatus as recited in claim 12, wherein said gate mounting means is an elongated shaft extending across said pyrolysis chamber above said elongated cavity and extending through and rotatably mounted at its opposite end portions to a pair of said opposite sides of said casing.

14. The apparatus as recited in claim 13, wherein said stop and release mechanism also includes an actuator mounted along an exterior of said casing and coupled to said shaft, said actuator being extendable and retractable to rotate said shaft and thereby pivotally move said gate between said closed and opened positions relative to said elongated cavity.

15. A material processing apparatus, comprising:

(a) a casing having a top and bottom and a plurality of sides defining a pyrolysis chamber for receiving feed materials therein and pyrolyzing the feed materials into a gaseous material and a solid ash residue;

(b) a mass of refractory material contained in said casing upon said bottom thereof and spaced below said top thereof and extending between said sides thereof, said refractory mass including an inclined upper surface defining a bottom of said pyrolysis chamber and having a lower terminal edge being spaced from a first one of said sides of said casing for defining an elongated cavity forming a solid ash residue collection region therein; and (c) means disposed in said pyrolysis chamber adjacent to said terminal edge of said inclined upper surface of said refractory mass for controlling the flow of waste material from said lower terminal edge into said elongated cavity of said ash residue collection region so as to regulate the residence time of the feed materials in said pyrolysis chamber before reaching said elongated cavity therein to ensure substantially complete pyrolyzing of the feed materials into gaseous and solid ash residue forms which are substantially sterile, inert and non-hazardous to the environment;

(d) said waste material flow controlling means including a lower surface section being provided on said inclined upper surface with a slope shallower than that of an upper surface section of said inclined upper surface such that said shallower-sloped lower surface section contributes to regulation of the residence time of the feed materials within said pyrolysis chamber by slowing the speed of descent of the feed materials down said inclined upper surface as the materials near said lower terminal edge thereof before reaching said elongated cavity;

(e) said waste material flow controlling means also including a feed material stop and release control mechanism mounted to said casing and extending within said pyrolysis chamber above said elongated cavity therein and being operable to selectively prevent and permit passage of the feed material, after pyrolysis, into said elongated cavity.

16. The apparatus as recited in claim 15, wherein said lower surface section of said inclined upper surface is disposed in a nearly horizontal plane.

17. The apparatus as recited in claim 16, wherein said upper surface section of said inclined upper surface is substantially longer than said lower surface section thereof.

18. The apparatus as recited in claim 15, wherein said stop and release control mechanism includes:

an elongated gate; and means for mounting said gate across an open top of said elongated cavity adjacent to said lower terminal end and said lower surface section of said inclined upper surface of said refractory mass and to undergo pivotal movement between closed and opened positions and thereby regulate the residence time of the feed materials within said pyrolysis chamber by selectively preventing and permitting the material to pass over said lower terminal end of said inclined upper surface and descend into said elongated cavity.

19. The apparatus as recited in claim 18, wherein said gate mounting means is an elongated shaft extending across said pyrolysis chamber above said elongated cavity and extending through and rotatably mounted at its opposite end portions to a pair of said opposite sides of said casing.

20. The apparatus as recited in claim 19, wherein said stop and release mechanism also includes an actuator mounted along an exterior of said casing and coupled to said shaft, said actuator being extendable and retractable to rotate said shaft and thereby pivotally move said gate between said closed and opened positions relative to said elongated cavity.

21. The apparatus as recited in claim 1, wherein said upper surface of said refractory mass is inclined.

* * * * *